US006293104B1

(12) United States Patent
Kangai et al.

(10) Patent No.: US 6,293,104 B1
(45) Date of Patent: Sep. 25, 2001

(54) CONDENSER, POWER PLANT EQUIPMENT AND POWER PLANT OPERATION METHOD

(75) Inventors: Naoki Kangai; Kazuhiro Ohtomo; Mitsuru Sudo, all of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/570,462

(22) Filed: May 12, 2000

(30) Foreign Application Priority Data

May 17, 1999 (JP) ..... 11-135377

(51) Int. Cl.[7] ..... F01K 13/00
(52) U.S. Cl. ..... 60/645; 60/670
(58) Field of Search ..... 60/645, 670

(56) References Cited

U.S. PATENT DOCUMENTS 3,913,331 * 10/1975 Conwell ..... 60/670 X
4,873,829 * 10/1989 Williamson ..... 60/670
5,255,519 * 10/1993 Kakovitch ..... 60/670 X

FOREIGN PATENT DOCUMENTS 3-248030 11/1991 (JP) .
5-264393 10/1993 (JP) .
6-11406 1/1994 (JP) .

* cited by examiner

*Primary Examiner*—Hoang Nguyen
(74) *Attorney, Agent, or Firm*—Mattingly, Stanger & Malur, P.C.

(57) ABSTRACT

A condenser for use in a power plant includes a steam condensing zone having a heat exchanger tube bundle for condensing steam into condensate and a hot well zone allowing the condensate to stay therein. A plurality of detectors for detecting the quality of the condensate and/or detection ports for taking out a sample of the condensate are provided in the hot well zone. The control valve is provided on a feed water system for adjusting the supply of the condensate to be supplied from the condenser to the feed water system on the basis of water quality detection values detected by the plurality of detectors and/or detection ports and a make-up water system is provided for supplying make-up water to the feed water system on the downstream side of the control valve.

18 Claims, 12 Drawing Sheets

CONDENSER, POWER PLANT EQUIPMENT AND POWER PLANT OPERATION METHOD

BACKGROUND OF THE INVENTION

1. Technical Field of the Invention

The present invention relates to a condenser, a power plant and an operation method thereof.

2. Description of Prior Arts

In a fossil power plant, nuclear power plant, or the like, steam exhausted from a steam turbine is cooled by a condenser using sea water as cooling water. However, since sea water is used as cooling water in the condenser as mentioned above, sea water has become a cause of corrosion or the like of structural apparatus and piping, etc. of the power plant when the sea water flowed into the condenser, so that it is necessary to monitor always water quality inside the system to find whether or not sea water leaks into the interior of the condenser. If the water quality inside the system exceeds a set value because of leakage of sea water into the interior of the condenser, a signal is issued from a detection part, and an alarm is generated on a monitor, operation panel, etc. An operator has received the alarm, identified a position and degree of the leakage, and judged whether or not the plant operation was stopped or continued according to the result, and they were operated manually.

Further, as an example of conventional water quality monitors, there are proposals disclosed in JP A 3-248030, JP A 6-11406 and JP A 5-264393.

For example, JP A 3-248030 discloses an apparatus in which a condenser hot well is divided into a first water chamber and a second water chamber by a partition wall, an electric conductivity measuring apparatus is provided in each water chamber and it is monitored whether or not an absolute value of difference between two electric conductivities is within an upper limit value. JP A 6-11406 discloses an apparatus in which the conductivity of a sample liquid which is taken from a condenser and deaerated by a gas-permeable film and the conductivity of a sample liquid taken from a recirculating water delivered by a condenser pump and deaerated in the similar manner are compared, whereby mixing of sea water is judged. Further, JP A 5-264393 discloses an apparatus in which water quality is detected in a plurality of positions of piping of a condenser system, leakage is judged at each position and total diagnosis of those leakage conditions are classified in steps and displayed.

However, the apparatus disclosed in JP A 3-248030, JP A 6-11406 and JP A 5-264393 each are provided with a detection point for taking out detection water in a condenser outlet through which the whole condensate passes, on the downstream side of a condenser pump for delivering condensate in the condenser, or in piping connecting from the condenser to a steam generator. However, in the case where the detection point is provided in the condenser outlet or on the downstream side of the condenser pump for delivering condensate in the condenser, or in the piping connecting the condenser to the steam generator, a time is taken until sea water leakage is detected, whereby there is the possibility that the water mixed with sea water is flowed out from the condenser even if the plant is stopped or a feed water system is closed after the detection of sea water leakage, and that the sea water-mixed water flows into the steam generator and steam turbine since the sea water-mixed water is delivered by the condenser pump.

SUMMARY OF THE INVENTION

An object of the present invention is to provide a condenser, power plant equipment and operation method thereof, in which leakage of cooling water is detected early and it is suppressed that water mixed with sea water due to the sea water leakage or the like flows into a steam generator and a steam turbine.

The present invention provides the following condenser:

That is, a condenser of the present invention condenses steam flowed therein from a turbine and supplies the condensate into a feed water system leading to a steam generator, and comprises a steam condensing zone having a heat exchanger tube bundle and condensing steam and a hot well zone allowing the condensate condensed in the steam condensing zone to stay, wherein a plurality of detectors for detecting the quality of the condensate and/or detection ports taking out the condensate are provided in the hot well zone, a control valve adjusting supply of the condensate to be supplied from the condenser to the feed water system on the basis of water quality detection values detected from the plurality of detectors and/or detection ports is provided on the feed water system, and a make-up water system supplying make-up water to said feed water system on the downstream side of said control valve is provided.

Further, a condenser according to the present invention condenses steam flowed therein from a turbine and supplies the condensate into a feed water system leading to a steam generator, and the condenser comprises a steam condensing zone having a heat exchanger tube bundle and condensing steam and a hot well zone allowing the condensate condensed in the steam condensing zone to stay there, a plurality of detectors for detecting the quality of the condensate and/or detection ports taking out the condensate are provided in the hot well zone, and a chemical injecting system supplying chemical dilution water to the feed water system on the basis of water quality detection values detected from the plurality of detectors and/or detection ports is provided.

Preferably, the detectors and/or detection ports are arranged separately from each other in a course leading from an upstream side of the hot well zone into which the condensate flows from the steam condensing zone to a downstream side of the hot well zone from which the condensate flows out into the feed water system, and a judging device for comparing respective water quality values detected from the detectors and/or detection ports, and judging sea water leakage when a water quality detection value detected from the detectors and/or detection ports on the upstream side represents to be lower in water quality detection value than a water quality detection value detected from the detectors and/or detection ports on the downstream side.

The present invention provides the following power plant equipment:

That is, a power plant equipment according to the present invention comprises a steam generator generating steam, a steam turbine driven by the steam generated in the steam generator, a condenser condensing the steam exhausted from the steam turbine into condensate, and a feed water system supplying the condensate to the steam generator, wherein the condenser comprises a steam condensing zone having a heat exchanger tube bundle and condensing steam and a hot well zone allowing the condensate condensed in the steam condensing zone to stay, a plurality of detectors for detecting the quality of the condensate and/or detection ports taking out the condensate are provided in the hot well zone, a control valve adjusting supply of the condensate to be supplied from the condenser to the feed water system on the basis of a water quality detection value detected from the plurality of detectors and/or detection ports is provided on the feed water system, and a make-up water system communicating with the feed water system on the downstream side of the control valve and supplying make-up water is provided.

Further, a power plant equipment according to the present invention comprises a steam generator generating steam, a steam turbine driven by the steam generated in the steam generator, a condenser condensing the steam exhausted from the steam turbine into condensate, and a feed water system supplying the condensate to the steam generator, wherein the condenser comprises a steam condensing zone having a heat exchanger tube bundle and condensing steam and a hot well zone allowing the condensate condensed in the steam condensing zone to stay, a plurality of detectors for detecting the quality of the condensate and/or detection ports taking out the condensate are provided in the hot well zone, and a chemical injecting system supplying chemical dilution water to the feed water system on the basis of the water quality detection values detected from the detectors and/or detection ports is provided.

Preferably, the above-mentioned power plant equipment is provided with a make-up water tank having make-up water stored therein and an apparatus for supplying the make-up water stored in the make-up water tank to the condenser or the feed water system.

Further, preferably, the above-mentioned power plant equipment is provided with a chemical storage tank storing chemical dilution water for neutralizing the condensate mixed with sea water, and a chemical dilution water supplying apparatus supplying the chemical dilution water stored in the chemical storage tank to the condenser or the feed water system.

Further, preferably, there is provided a discharging system for discharging, out of the feed water system, condensate on the upstream side of a control valve controlling a flow rate of the condensate to be supplied to the steam generator.

The present invention provides the following operation method of power plant equipment:

That is, an operation method of a power plant equipment comprising a steam generator generating steam, a steam turbine driven by the steam generated in the steam generator, a condenser condensing the steam exhausted from the steam turbine into condensate, and a feed water system supplying the condensate to the steam generator, comprises the steps:

detecting the water quality of condensate at a plurality of detecting points in a hot well zone allowing the condensate condensed inside the condenser to stay, judging sea water leakage on the basis of the detection values of water quality detected at the plurality of detecting points, adjusting supply of the condensate to be supplied from the condenser to the feed water system by operating a control valve arranged in the feed water system when judged to be sea water leakage, and supplying make-up water to the feed water system from a make-up water system communicating with the feed water system on the downstream side of the control valve.

Further, a method of operating a power plant equipment according to the present invention, which equipment comprises a steam generator generating steam, a steam turbine driven by the steam generated in the steam generator, a condenser condensing the steam exhausted from the steam turbine into condensate, and a feed water system supplying the condensate to the steam generator, comprises the steps:

detecting the water quality of condensate at a plurality of detecting points in a hot well zone allowing the condensate condensed inside the condenser to stay, judging sea water leakage on the basis of detection values of water quality detected at the plurality of detecting points, and supplying chemical or chemical dilution water to the feed water system when sea water leakage is judged.

Preferably, in a method of operating the above-mentioned power plant equipment, the condensate mixed with sea water is discharged out of the feed water system in a middle flow course from the condenser to the steam generator when judged to be sea water leakage.

Further preferably, the method comprises:

detecting the water quality of condensate at separate positions in a course from an upstream side of a hot well zone allowing the condensate condensed inside the condenser to stay to a downstream side of the hot well zone from which the condensate flows out into the feed water system, comparing respective water quality values detected at the detecting points, and judging sea water leakage when a water quality detection value detected at one of the detecting points on the upstream side represents to be lower in water quality than a water quality detection value detected at one of the detecting points on the downstream side.

Here, chemical may be medicine as long as it has a function of neutralizing sea water.

DESCRIPTION OF EMBODIMENTS OF THE INVENTION

Figure 2:
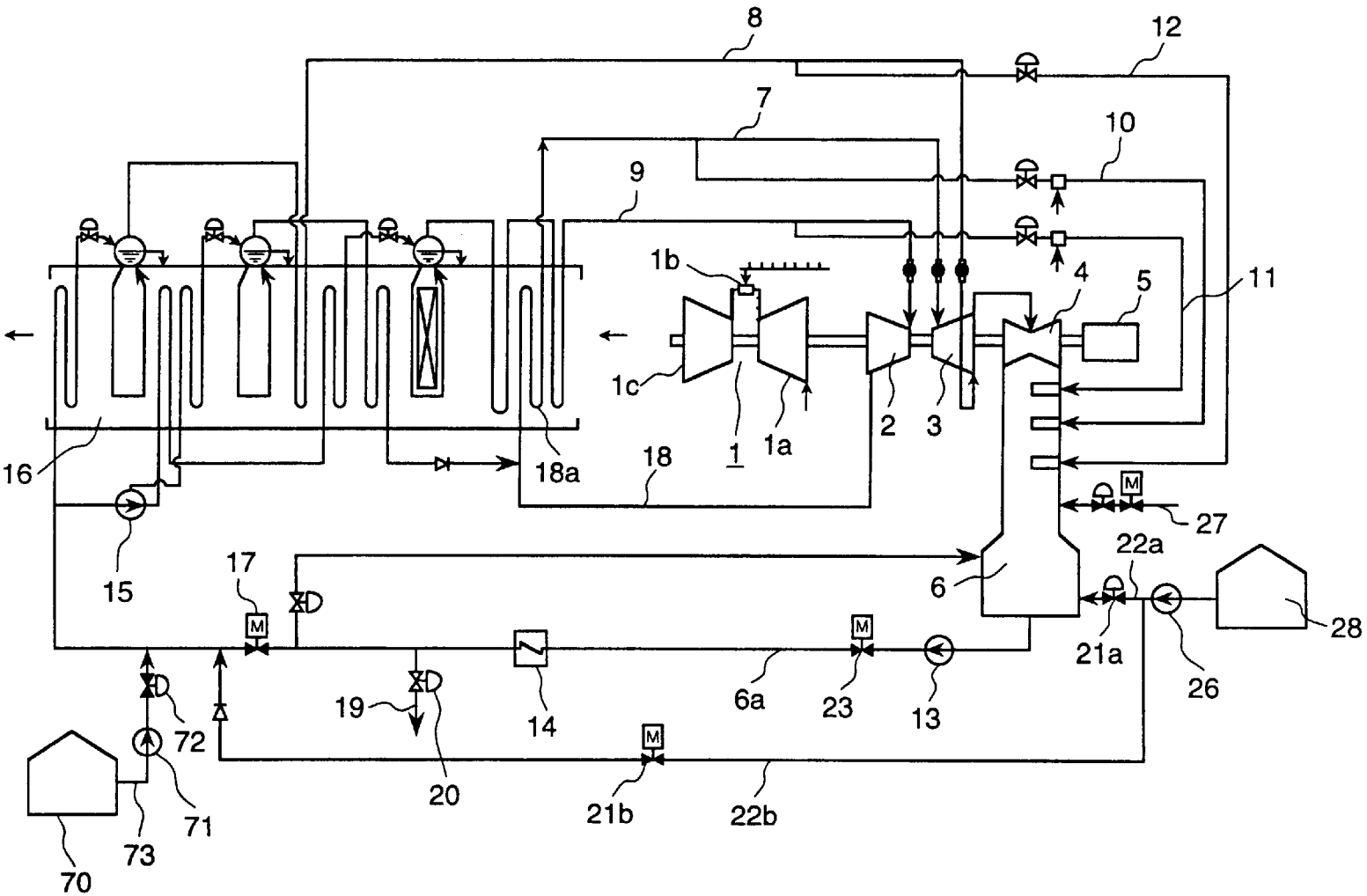
FIG. 2 is a diagram of a system construction of an electric power plant of an embodiment of the present invention.

FIG. 2 is a diagram of a system construction of a power plant of an embodiment of the present invention.

A power plant of the present embodiment is roughly classified as and composed of a gas turbine system, a steam turbine system, a condenser, a feed water system and a steam generator system.

The gas turbine system 1 is composed of a compressor 1*a* compressing air, a combustor 1*b* mixing the air compressed by the compressor 1*a* with fuel and burning them, a gas turbine 1*c* driven by the combustion gas burnt by the combustor 1*b*.

Further, the stem turbine system is composed of a high pressure steam turbine 2, an intermediate pressure steam turbine 3 and a low pressure steam turbine 4. Steam heated by the steam generator system as described later is supplied to the steam turbine system. Further, in the present embodiment, the gas turbine 1*c*, the high pressure steam turbine 2, the intermediate pressure steam turbine 3 and the low pressure steam turbine 4 have a driving shaft formed in one shaft, and electric power is generated by driving an electric generator 5 connected to the driving shaft.

The condenser/feed water system is composed of a condenser 6 condensing into condensate the steam finished to work in the low pressure turbine 4 through heat-exchange with cooling water such as sea water, and feed water piping 6*a* supplying the condensate condensed by the condenser 6 to an exhaust heat recovery boiler system. Here, the condensate condensed in the condenser 6 collects in a hot well zone not shown inside the condenser, and it is delivered from a lower portion of the condenser 6 to a condensate pump 13 to be raised in pressure. The condensate raised in pressure by the condensate pump 13 is supplied to each of a boiler feed water pump 15 and an exhausted heat recover boiler 16 through a condensate stop valve 23, a ground steam condenser 14 and a feed water stop valve 17. Further, in the case where water is in excess in the system, the excessive water is discharged out of the system through discharge piping 19 provided on the feed water piping 6*a*. by controlling a discharge flow regulation valve 20 provided thereon.

Further, auxiliary steam supply piping 27 auxiliarily supplying steam into the condenser 6 and promoting to deaerate and make-up water piping 22*a* are connected to the condenser 6. The make-up water piping 22*a* has a make-up water supply valve 21*a* mounted thereon and a make-up water tank 28 connected thereto through a make-up water pump 26. Further, make-up water piping 22*b* supplying make-up water delivered by the make-up water pump 26 to the feed water piping 6*a* on the downstream side of a feed water stop valve 17 mounted the feed water piping 6*a* is connected to the make-up water piping 22*a*. This make-up water piping 22*b* has a make-up water supply valve 21*b* mounted thereon.

Further, in the present embodiment shown in FIG. 2, make-up water to be supplied to the feed water piping 6*a* is introduced from the make-up water tank 28. However, it is possible to supply condensate from another condenser 6 not shown to the feed water piping 6*a* in the case where a plurality of the power plants one of which is shown in FIG. 2 are equipped. Further, it also is possible to change the condensate to condensate in another condensate chamber and to supply it in the case where the condenser 6 is provided with a plurality of condensate chambers.

Further, a chemical storage tank 70 storing chemical or chemical dilution water is connected to the feed water piping 6*a* through a chemical supply piping 73. A chemical transfer pump 71 delivering chemical dilution water and a flow adjusting valve 72 adjusting a flow rate of the chemical dilution water are mounted on the chemical supply piping 73. In the present embodiment shown in FIG. 2, an injection point of the chemical dilution water is arranged on the downstream side of the feed water stop valve 17, however, it is possible to inject it in the feed water piping 6*a* on the upstream side of the feed water stop valve 17, or into a boiler drum of the exhaust heat recovery boiler 16.

In the exhaust heat recovery boiler 16 which is the steam generator system, steam is generated by using high temperature exhaust heat exhausted from the gas turbine. The condense supplied by the boiler feed pump 15 is heated in the exhaust heat recovery boiler 16 to become steam, and the steam generated here flows through a main steam piping 9 and flows into the high pressure steam turbine 2. Further, the steam exhausted from the high pressure steam turbine 2 flows through high pressure turbine exhaust piping 18, mixes with intermediate pressure steam and then is heated again by a reheater 18*a* of the exhaust heat recovery boiler 16. The steam reheated by the reheater 18*a* flows through reheat steam piping 7 and is supplied to the intermediate pressure steam turbine 3. On the other hand, the low pressure steam heated in the exhaust heat recovery boiler 16 is supplied to the intermediate pressure steam turbine 3 through low pressure steam piping 8. The steam supplied to the intermediate pressure steam turbine 3 through the reheat steam piping and the low pressure steam piping 8 is mixed to be low pressure steam, and the low pressure steam is supplied to the low pressure turbine 4. Further, high pressure turbine bypass piping 11, intermediate pressure turbine bypass piping 10 and low pressure turbine bypass piping 12 are connected to the main steam piping 9, the reheat steam piping 7 and the low pressure steam piping 8, respectively.

Next, a concrete embodiment of the condenser 6 shown in FIG. 2 will be explained, referring to FIG. 1.

Steam 35 exhausted from the steam turbine flows into the interior of a condenser barrel 31 from an upper portion of the condenser 6. The steam 35 flowed in the condenser barrel 31 passes through between a tube bundle 29 of heat conductive tubes in which cooling water, for example, sea water flows, whereby heat-exchange is effected. The steam 35 heat-exchanged is condensed to be condensate 44 and drops in a hot well zone 41. The dropped condensate 44 stays in the hot well zone 41, flows on a bottom surface inclined to a condenser outlet 36 and is led to the outside of the condenser 6.

Further, the condenser 6 of the present embodiment is provided with a plurality of detection water taking out ports 33, 39, 45 in the hot well zone 41 in which the condensate 44 drops. The detection water taking out ports 33 are arranged at positions right under the tube bundle 29, or at positions at which the condensate drops and stays first or in the vicinity thereof. That is, it is preferable to arrange them right under the tube bundle 29 at which steam heat-exchanges, or in the vicinity of the tube bundle 29. Further, the detection water taking out port 39 is arranged at the condenser outlet 36 from which the condensate 44 stayed in the hot well zone 41 is discharged, or in the vicinity thereof. Further, the detection water taking out port 45 is arranged at an about middle portion between the detection water taking out port 33 positioned right under the tube bundle 29 and the condenser outlet 36 from which the condensate 44 is discharged or its near portion, or at a position on the way of flow of the condensate 44 stayed in the hot well zone 41 to the condenser outlet 36. The detection water taken out at the detection water taking out ports 33, 39 and 45 are subjected to water quality inspection by an inspection apparatus not shown in FIG. 1. Further, in FIG. 1, the detection water taking out ports 45 also are arranged at corner portions of the hot well zone 41.

In this manner, in the present embodiment, water quality inspection of the condensate 44 is effected at the upstream and downstream positions in the hot well zone 41, at an about middle position of the flow path of condensate flowing from the upstream side to the downstream side in the hot well zone 41, or at a position on the way of the flow path. That is, the detection water taking out ports are separately arranged in the course inside the hot well zone 41 from the upstream side at which condensate condensed by the tube bundle 29 flows in to the downstream side at which the condensate is discharged. Further, detection water (condensate) taken out at the detection water taking out ports 33, 39, 45 shown in FIG. 1 is led to a water quality measuring apparatus not shown through piping connected to each of the detection water taking out ports, and the quality of the detection water taken out from each of the detection water taking out ports is inspected in the water quality measuring apparatus.

Further, although it is possible to directly monitor the water quality by arranging detectors inside the condenser (hot well zone 41), since the conditions of temperature, flow rate or the like of the condensate staying in the hot well zone 41 are not constant, there is the concern that a change of the conditions affects the water quality detection. Therefore, in the present embodiment, the detection water is taken out from the detection water taking out ports as mentioned above, whereby the measuring conditions of the condensate are made closely constant and it possible to more surely and precisely detect sea water leakage. Details of sea water leakage detection method will be described later.

As mentioned above, according to the present embodiment, the detection water taking out ports 33 are positioned right under the tube bundle 29, so that when sea water has leaked, sea water-mixed water is detected immediately after the condensate drops. Therefore, it is possible to take a long margin of time for taking countermeasures such as stop of condensate supply or the like by the time when the sea water-mixed condensate is supplied to the other plant components such as the steam generator, steam turbine, etc. Further, a detection value detected at the detection water taking out port 39 arranged in the vicinity of the condenser outlet 36 is delayed in time, as compared with a detection value detected right under the tube bundle 29.

Figure 1:
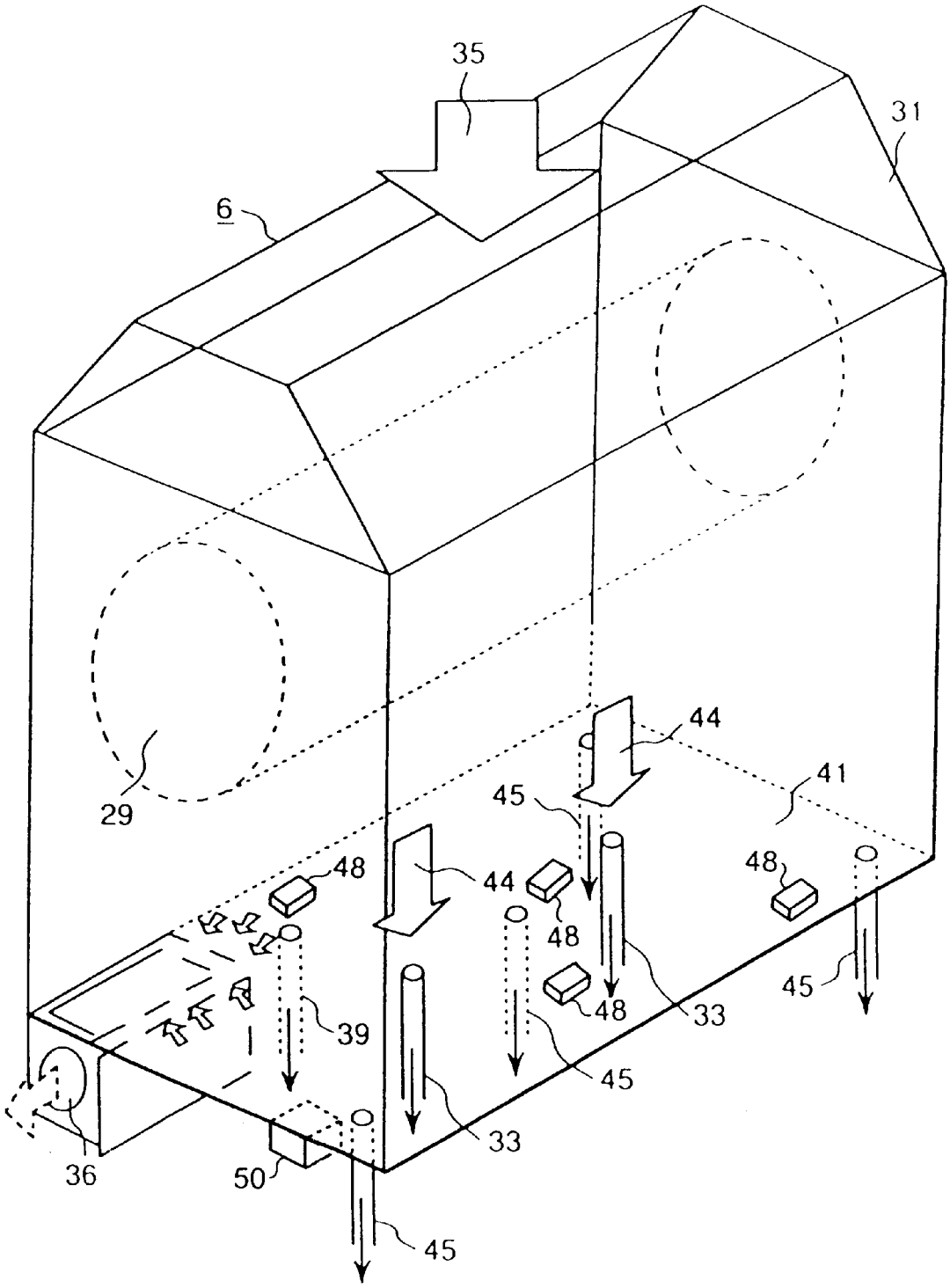
FIG. 1 is a schematic diagram of a construction of a condenser of an embodiment of the present invention.

Further, in FIG. 1, an example is shown in which the detection water taking out ports 33, 39, 45 are arranged in the hot well zone 41 as means for detecting the water quality of condensate, however, it is also possible to provide detectors 48 in the hot well zone which can detect sea water leakage. In this case, it is desirable to arrange the detectors at the same position as or in the vicinity of the detection water taking out ports 33, 39, 45 shown in FIG. 1. Further, it is also possible to arrange a combination of the detection water taking out ports and the detectors.

Figure 3:
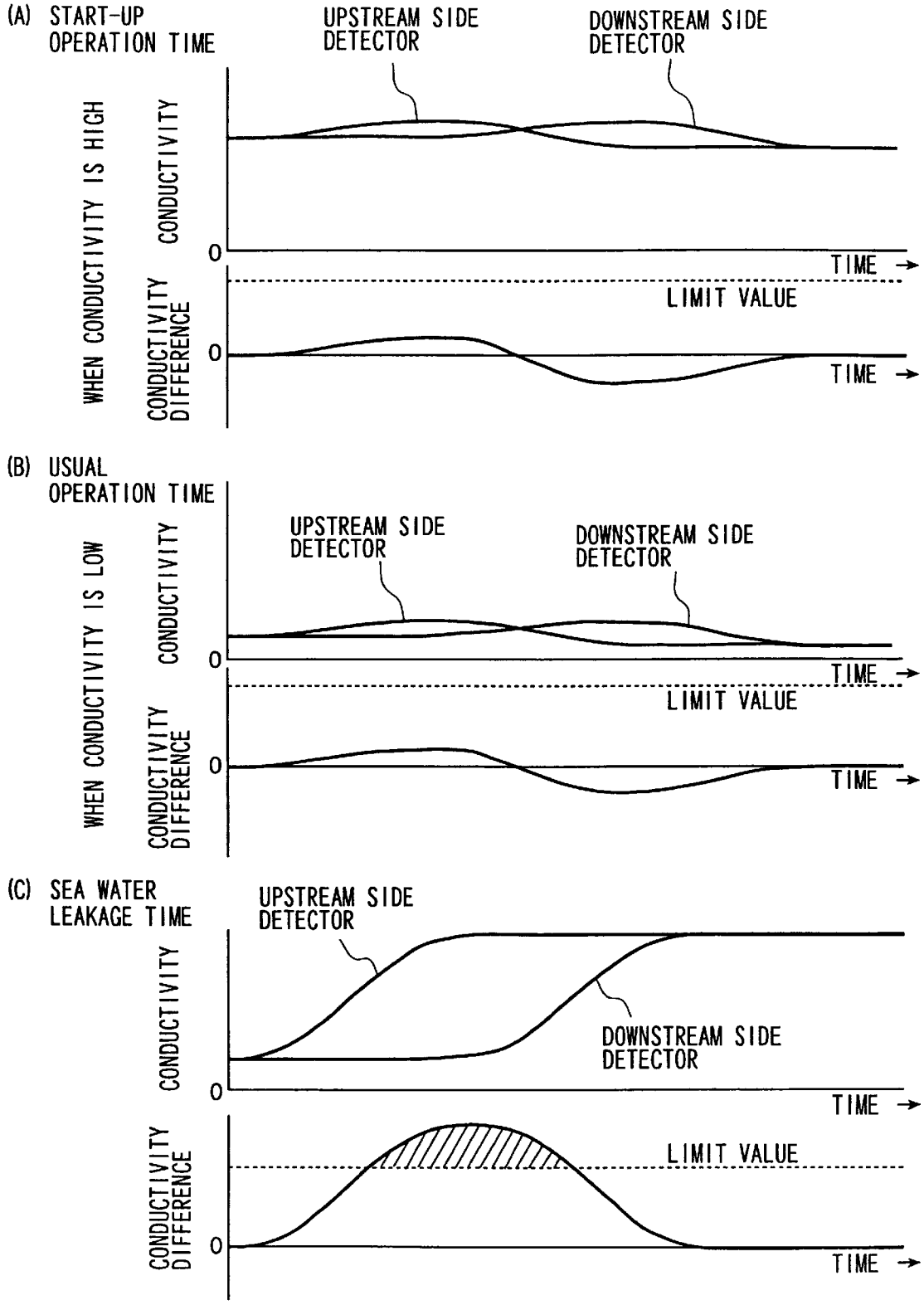
FIG. 3 is a graph showing an example of characteristics of conductivity and conductivity difference.

Next, a detection method of sea water leakage in the present embodiment will be explained, referring to FIG. 3. FIG. 3 shows an example of characteristics of electric conductivity and conductivity difference. A, B and C in FIG. 3 show electric conductivity characteristics at time of plant start-up, in time of usual operation and at time of sea water leakage, respectively. Further, in the present embodiment, conductivity detectors are used for water quality inspection, and the detection water taking out ports are arranged at the position right under the tube bundle 29, which is an upstream side in the hot well zone, and at the position of the condenser outlet 36 which is a downstream side.

In an electric power plant having a steam turbine, in some cases, the conductivity of the whole system changes largely at time of start by an influence of dissolved carbon dioxide, impurities, etc. That is, as shown in A, the conductivity becomes high at time of start or the like because a lot of dissolved carbon dioxides are contained, while the conductivity becomes low during usual operation as shown in B. Therefore, it can not be determined by monitoring only absolute values of the conductivity whether a cause of increase in the conductivity is due to the start or the like or due to leakage of cooling water such as sea water, so that it was necessary to switch a limit value for issuing alarm according to the operation conditions. Further, since time is necessary by the time that sea water is detected, even if the plant is stopped or the feed water supply system is closed after leakage detection, there is the possibility that sea water-mixed water flows into the steam generator, steam turbine and so on because the sea water-mixed water flows out from the condenser.

On the contrary, in the present embodiment, as mentioned above, the detection water taking out ports are arranged at positions on the upstream side and downstream side in the hot well zone, and difference in conductivity between detectors at the two positions is monitored. With the above-mentioned construction, for example, noticing the difference in conductivity between at the time of start operation of the plant in A and in time of usual operation in B, characteristics of change in conductivity become the same irrespective of the magnitudes of the inherent conductivity.

Here, in the case where leakage of sea water occurs as shown in C, sea water-mixed water is detected by the detector at the upstream side, and then detected by the detector at the downstream side with delay in time. Therefore, indication values of the detectors are largely different until the sea water-mixed water reaches the detector at the downstream side, and the difference in conductivity is large. Therefore, monitoring difference in conductivity between two positions makes it possible to early detect the leakage of sea water, and it is possible to detect only the leakage of cooling water such as sea water with high precision without resetting the limit value of alarm depending on the operation conditions.

Further, it is possible to judge by a judging device 50 whether the leakage is on a large scale or on a small scale, based on a degree of change in conductivity difference between at the two detection points. That is, the case where the conductivity difference increases rapidly to time passage or the case where the conductivity difference exceed a limit value set in advance each are judged that leakage on a large scale occurred. Further, the case where the conductivity difference slowly increases or the case where the conductivity difference is smaller than the limit value set in advance but the detected conductivity value does not decrease even after a certain time period has passed is judged that the leakage is on a small scale.

Here, when the leakage is judged to be on a large scale, the plant operation is stopped or the load is reduced to a load at which the operation is judged to be safe, and the system is separated so that the condensate mixed with cooling water such as sea water does not flow in. Further, when the leakage is judged to be on a small scale, chemical or chemical dilution water for neutralizing the sea water-mixed water is injected.

Figure 4:
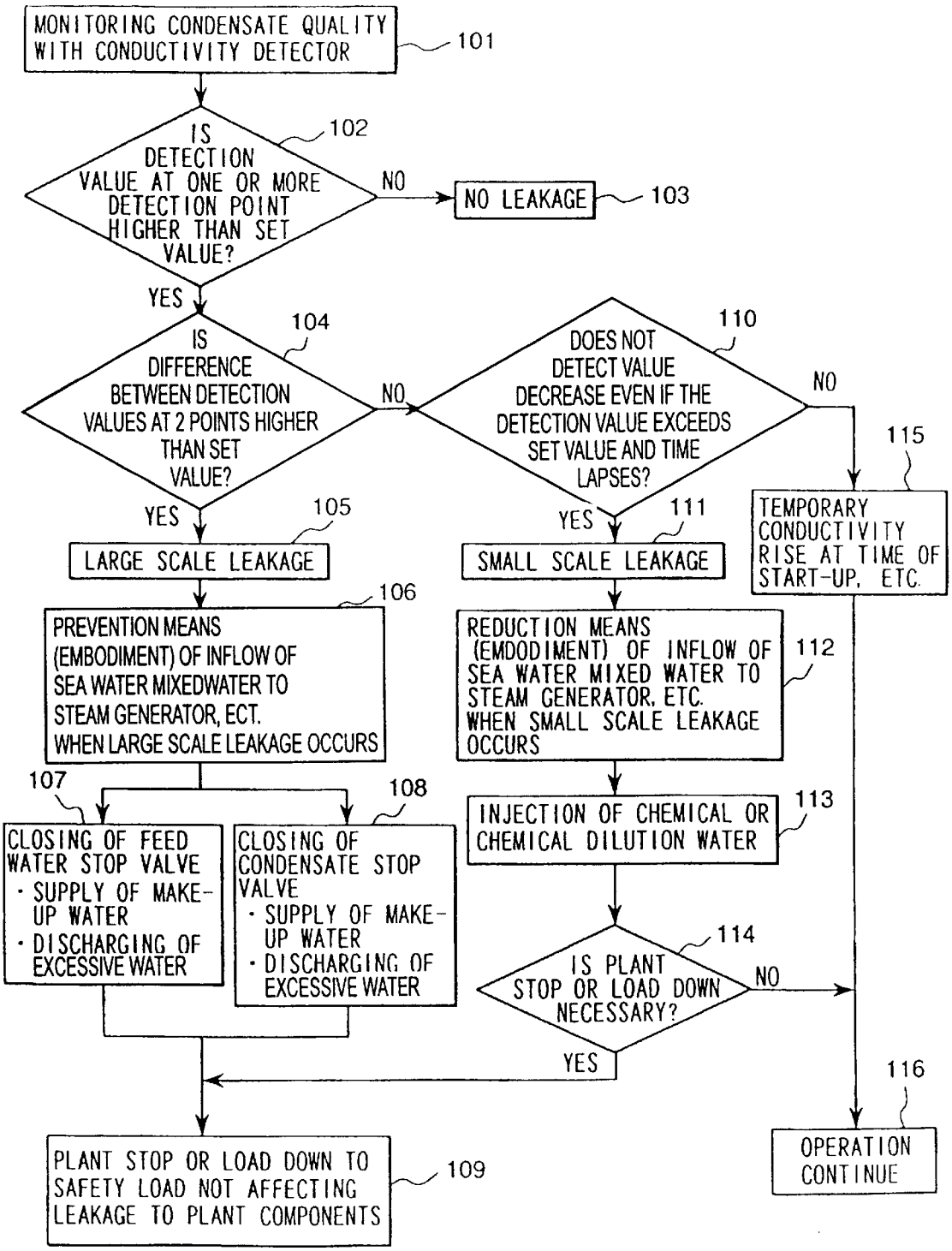
FIG. 4 is a flow chart of an operation method of a power plant of an embodiment of the present invention.

Hereunder, an operation method of the plant when sea water leaked is explained, referring to FIG. 4. FIG. 4 is a flow chart showing details of the plant operation method at the time of sea water leakage.

Usually, water quality inspection or monitoring inside the condenser is effected at upstream and downstream sides in the hot well zone (step 101). Judgement is effected on whether or not a detection value detected at the detecting point on the upstream side or on the downstream side is higher than a value set in advance (step 102), when values detected at the points on the upstream and downstream sides are lower than the set value, it is judged to be no leakage of sea water (step 103). Here, where a detection value detected by at least one of the detectors arranged on the upstream side inside the condenser indicates a higher value than the preset value, it is compared with a detection value detected at the detecting point on the downstream side (step 104). And, when a difference from the detection value at the detecting point on the downstream side is larger than a value set in advance, it is judged that leakage of sea water on a large scale occurred inside the condenser (step 105). In this case, in order to suppress inflow of condensate containing sea water into the steam generator or the like, it is necessary to stop supply of the condensate containing sea water into the steam generator or the like. Therefore, as shown in FIG. 4, a signal of sea water leakage is received and countermeasures for the inflow of sea water-mixed water into the steam generator or the like is automatically taken (step 106).

As an example thereof, a feed water stop valve 17 arranged on the upstream side of the steam generator is closed, whereby the sea water-mixed water flowing from the condenser is prevented from flowing to the downstream side. Further, in order to prevent the steam generator from boiling in low water or empty by stopping of water supply, make-up water stored in the make-up water tank is supplied to the feed water piping by the make-up water pump. Here, when water becomes excessive by supply of the make-up water, a discharge flow adjusting valve arranged on an discharge piping of a spill-over system is controlled to open by a controller, whereby excessive water is discharged (step 107). Further, as another example, a condensate stop valve arranged on the upstream side of the steam generator is closed, whereby the sea water-mixed water flowing from the condenser is suppressed to flow to a downstream side. Further, in order to prevent the steam generator from boiling in low water or empty due to stopping of condensate flow, make-up water stored in the make-up water tank is supplied to the feed water piping by the make-up water pump. Here, when water becomes excessive by supply of the make-up water, the discharge flow adjusting valve arranged on the discharge piping of the spill-over system is controlled to open by the controller, whereby excessive water is discharged (step 108). By those operations, it is possible to effect load down to a load at which an effect of leakage is not affected or to stop the plant while protecting the plant components (step 109).

Further, in FIG. 4, even if at least one of the upstream side detectors arranged inside the condenser indicates a higher value than a value set in advance, when a difference between the value and a value of the detector on the downstream side is smaller than a value set in advance (step 110), it is considered that there occur a temporary rise in conductivity or sea water leakage on a small scale to the extent that the conductivity does not rapidly increase. In this case, when a detected value does not decrease irrespective of continuation of the operation, it is judged to be leakage of cooling water such as sea water on a small scale inside the condenser (step 111). In the case of leakage on a small scale, since it is unnecessary to separate the leaking portion, practice a load down operation of the plant or stop the plant, a measure for reducing or mitigating an influence of the inflow of sea water-mixed water into the steam generator or the like is taken (step 112). As the reducing measure, for example, chemical or chemical dilution water for neutralizing the sea water-mixed water is injected, whereby an emergency measure is taken (step 113). After taking the reducing measure also, the water quality monitor on whether or not it is necessary to stop the plant or take a load down operation is continued (step 114). That is, when it was judged to be insufficient only by injection of chemical or chemical dilution water, the plant load down operation or plant stop operation is conducted (step 109), and when it was judged to be unnecessary to take the plant stop or the load down operation, the plant operation is continued (step 116). Further, as an example of chemical or chemical dilution water, soda phosphate or the like is generally used.

Further, in the case where at least one of the upstream detectors arranged inside the condenser indicates a higher value than a value set in advance, a difference between the value and a value of the detector arranged on the downstream side is smaller than a value set in advance and a detected value of conductivity decreases as operation time passes, such a case is judged to be a temporary rise in conductivity as at time of start (step 115) and the plant operation is continued (step 116).

Figure 5:
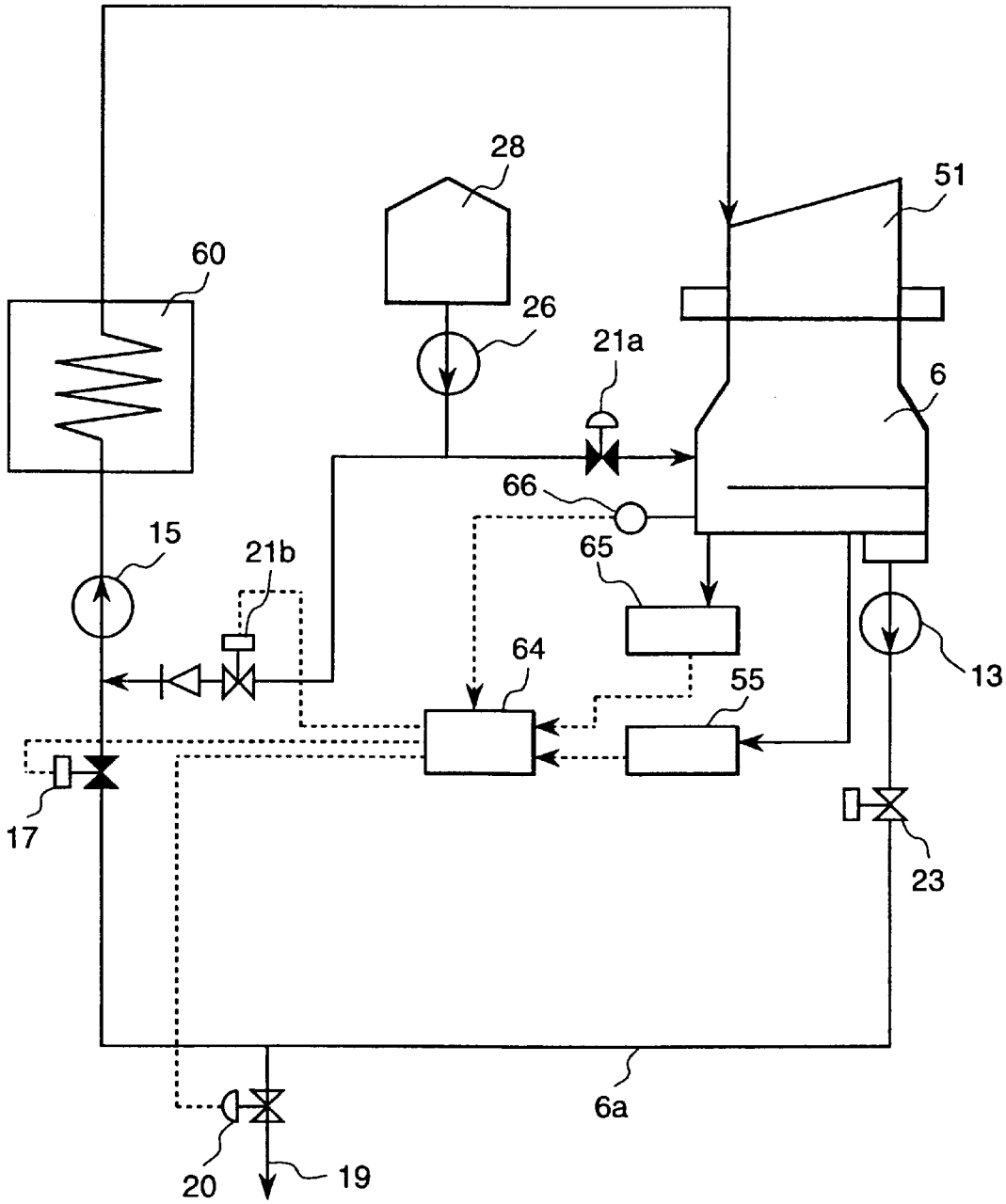
FIG. 5 is a diagram of a simplification of the system construction of the power plant shown in FIG. 2.

Next, a control method of the electric power plant of the present embodiment is explained, referring to FIG. 5. FIG. 5 is a schematic diagram of a system construction formed by simplifying the system construction in FIG. 2, and explanation of the same parts as in FIG. 2 are omitted.

The condenser 6 has a hot well zone not shown which is provided with an inlet and an outlet, at each of which detection water taking out ports are provided as previously described. The water taken out through piping is monitored of its quality at detecting portions 65, 55. Further, the condenser 6 is provided with a water level meter 66, a water level of the condensate stayed in the hot well zone is detected. Information detected at the detecting portions 65, 55 and by the water level meter 66 is transmitted to a controller 64. The controller 64 controls opening/closing of the feed water stop valve 17, the makeup water supply valve 21*b* and the discharge flow regulating valve 20 on the basis of the transmitted information.

In the present embodiment, detection of condensate is carried out at the detecting portions 65, 55 and the controller 64 detects change in detection values to judge a degree of leakage. If leakage of sea water occurred inside the condenser 6, it is necessary to suppress the inflow of sea water-mixed water into plant elements such as the steam turbine and so on and promptly separate the leakage portion. If a degree of the leakage is judged to be on a large scale by a detection result, the feed water stop valve 17 arranged on the upstream of the steam generator 60 is closed, thereby to prevent the sea water-mixed water flowed out of the condenser from flowing downstream. Further, in order to prevent the steam generator from boiling in low water or empty because of stopping water supply, make-up water stored in the make-up water tank is supplied to the feed water piping 6*a* by the make-up water pump 26. Here, in the case where make-up water is supplied and water becomes excessive, the discharge flow regulating valve 20 arranged on the discharge piping of the spill-over system is controlled so as to open by the controller 64, whereby excessive water is discharged.

As mentioned above, according to the present embodiment, since it is suppressed for sea water to flow into the steam turbine and so on when the leakage of sea water is on a large scale, upon receipt of a detection signal of the leakage, the controller 64 stops the feed water stop valve 17, makes up water to a downstream side of the feed water stop valve 17 and discharges, out of the system, the water which became excess by supply of the make-up water, whereby it is possible without depending on judgment of an operator to suppress, early and with high reliability, the outflow of cooling water-mixed condensate to a downstream side and the inflow thereof into the steam turbine 51 through the steam generator 60. Further, according to the present embodiment, it is possible to effect load down to a safety load at which an effect of leakage is not affected to the plant components, without emergency stop of the plant.

Figure 6:
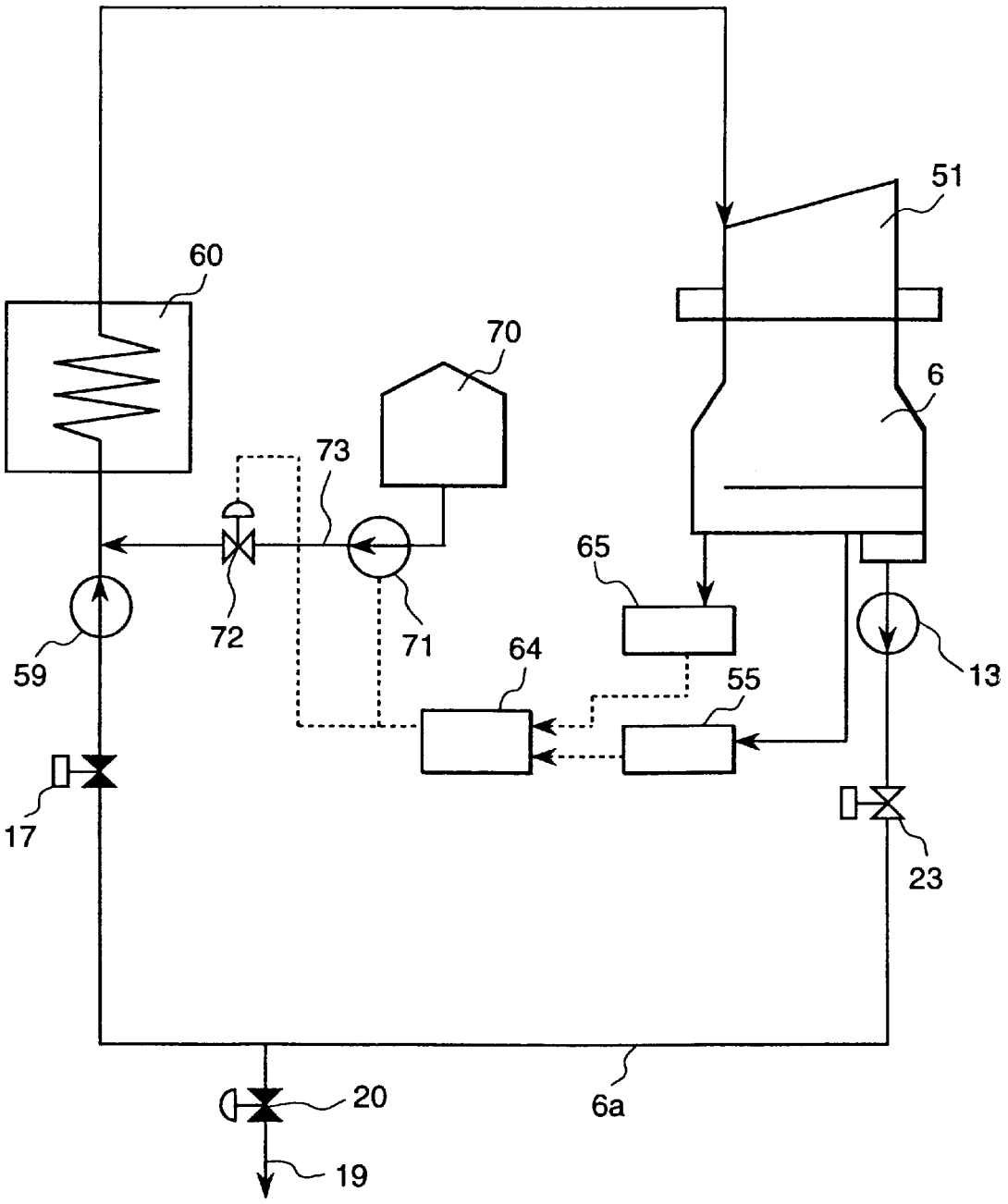
FIG. 6 is a diagram of another simplification of the system construction of the power plant shown in FIG. 2.

FIG. 6 is a schematic diagram of another system construction formed by simplifying the system construction shown in FIG. 2, and explanation of the same parts as in FIG. 2 are omitted.

In the present embodiment, there are provided a chemical storage tank 70 in which chemical or chemical dilution water is stored, a chemical supply piping 73 leading chemical or chemical dilution water to the steam generator 60, a chemical transfer pump 71 arranged on the chemical supply piping 73 and transferring chemical or chemical dilution water, and a flow regulating valve 72 regulating a flow rate of chemical or chemical dilution water to be supplied to the steam generator 60.

Further, at a portion right under the tube bundle of the hot well zone not shown of the condenser 6 and at the condenser outlet, the detection water taking out ports are provided as previously described, and the water taken out through piping is monitored of its quality at the detecting portions 65, 55. Information detected at the detecting portions 65, 55 is transmitted to the controller 64. The controller 64 controls the chemical transfer pump 71 and flow regulating valve 72 on the basis of the transmitted information.

In the present embodiment, the quality monitoring of condensate is carried out at the detecting portions 65, 55 and the controller 64 detects a change in detection values to judge a degree of leakage. If the leakage of cooling water, for example, sea water occurred inside the condenser 6 and a degree of the leakage is judged to be on a small scale, chemical or chemical dilution water in the chemical storage tank 70 is supplied into the feed water piping 6*a* by the chemical transfer pump 71 while continuing the operation of the plant, and then the plant is stopped manually.

In the present embodiment, in the case where cooling water leakage is on a small scale and it is unnecessary to stop immediately an outflow of condensate from the condenser 6 but it is necessary to take countermeasures for the leakage, chemical or chemical dilution water for damping or reducing an influence of the sea water-mixed condensate to the steam turbine is injected while controlling an injection quantity according to signals from the controller 64. By the above-mentioned control, load down to a load at which the plant components are not affected by the leakage can be carried out without emergency stop of the plant.

Figure 7:
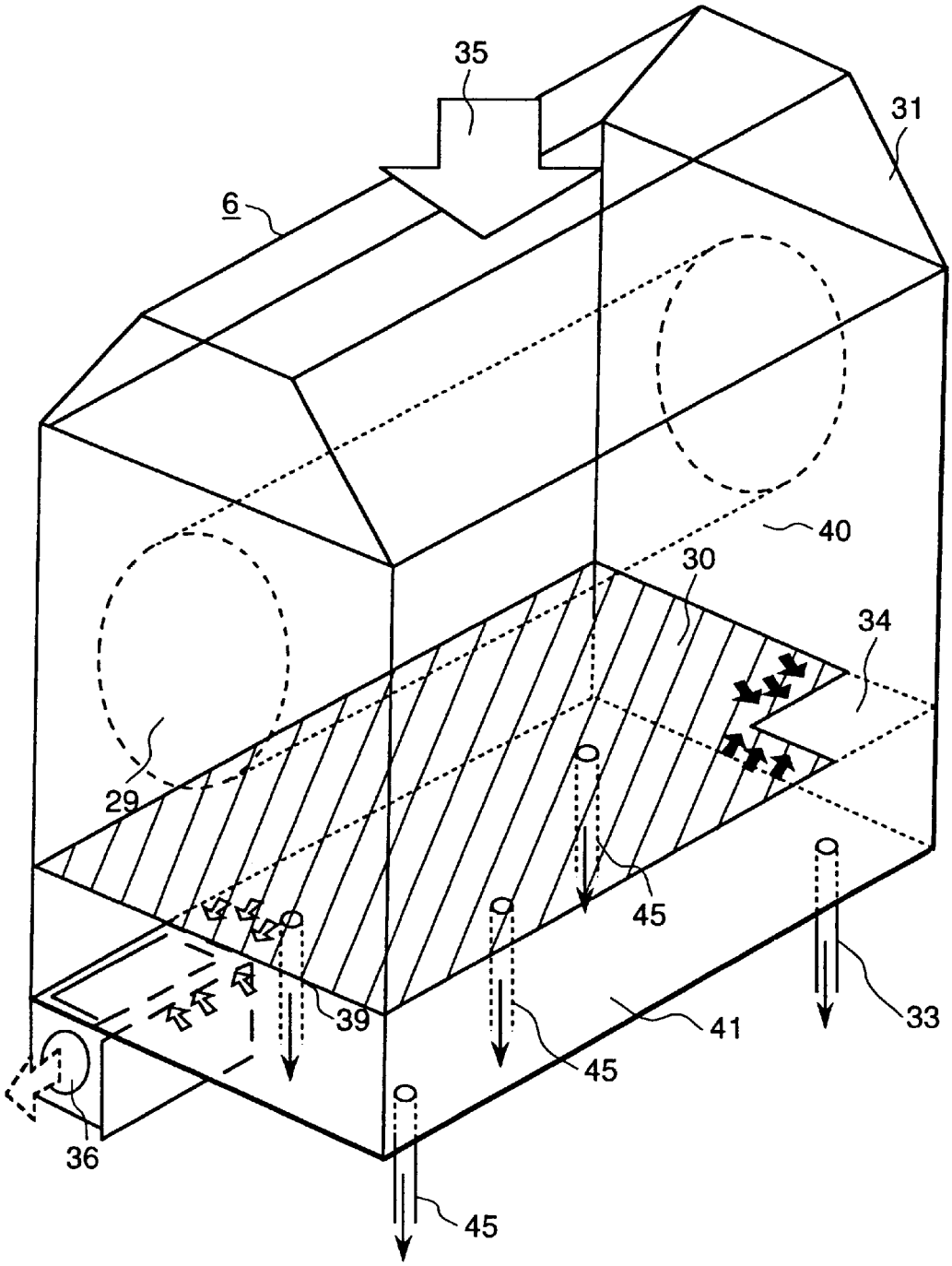
FIG. 7 is a view of a modification of the condenser shown in FIG. 1.

FIG. 7 is a view of a modification of the condenser shown in FIG. 1. In the present embodiment, the inside of the condenser is partitioned into a steam condensing zone 40 and a hot well zone 41 by a structural member 30 such as a top plate.

Steam 35 exhausted from the steam turbine flows from upward of the condenser 6 into the steam condensing zone 40 inside a condenser barrel 31. The steam 35 flowed in passes through the tube bundle 29 inside which cooling water such as sea water flows, whereby heat exchange is effected. The heat-exchanged steam 35 is condensed to be condensate and the condensate drops onto the structural member 30. The condensate dropped on the structural member 30 flows on the structure member 30 and flows into the hot well zone 41 through a communication portion 34 formed at a corner of the structural member 30. The condensate introduced into the hot well zone 41 flows inside the hot well zone 41 and is discharged to the outside at the condenser outlet 36. Further, the communication portion 34 communicating the steam condensing zone 40 and the hot well zone 41 is formed so that the condensate flows therein at a farthest portion from the condenser outlet 36 with respect to a water flow inside the hot well zone 41.

Further, in the hot well zone 41, the detection water taking out port 33 for monitoring the quality of condensate is arranged right under the communication portion 34 or in the vicinity thereof, that is, at the most upstream side in the hot well zone 41. Further, the detection water taking out port 39 is arranged at the condenser outlet 36 for discharging the condensate 44 stayed in the hot well zone 41 or in the vicinity thereof, that is, at the most downstream portion in the hot well zone 41. Further, the detection water taking out port 45 is arranged around a middle portion between the detection water taking out port 33 arranged at the portion at which the condensate 44 flows in the hot well zone 41 or in the vicinity thereof and the detection water taking out port 39 arranged at the condenser outlet 36 discharging the condensate 44 stayed in the hot well zone 41 or in the vicinity thereof, or it is arranged at a portion on the way of a flow path in which the condensate 44 flowed in the hot well zone 41 flows to the condenser outlet 36.

According to the present embodiment, even if leakage of cooling water, for example sea water occurred, it is possible to detect the leakage by the detection water taking out port 33 immediately after sea water-mixed water flows into the hot well zone 41. Therefore, it is possible to make long a margin in time necessary to take measures for stopping the supply of condensate and so on by the time that the condensate mixed with sea water is supplied to the other plant components such as the steam generator, steam turbine and so on. In this manner, by monitoring a difference in conductivity between at two detecting points, early detection of leakage becomes possible, further it is possible to surely judge whether the leakage of sea water is on a large scale or on a small scale without resetting a limit value for alarm according to operational conditions. Further, in the case where it is judged to be leakage of sea water, countermeasures therefor is selected according to the scale of the sea water leakage in the same manner as in the flow chart of FIG. 4 as previously mentioned.

Figure 8:
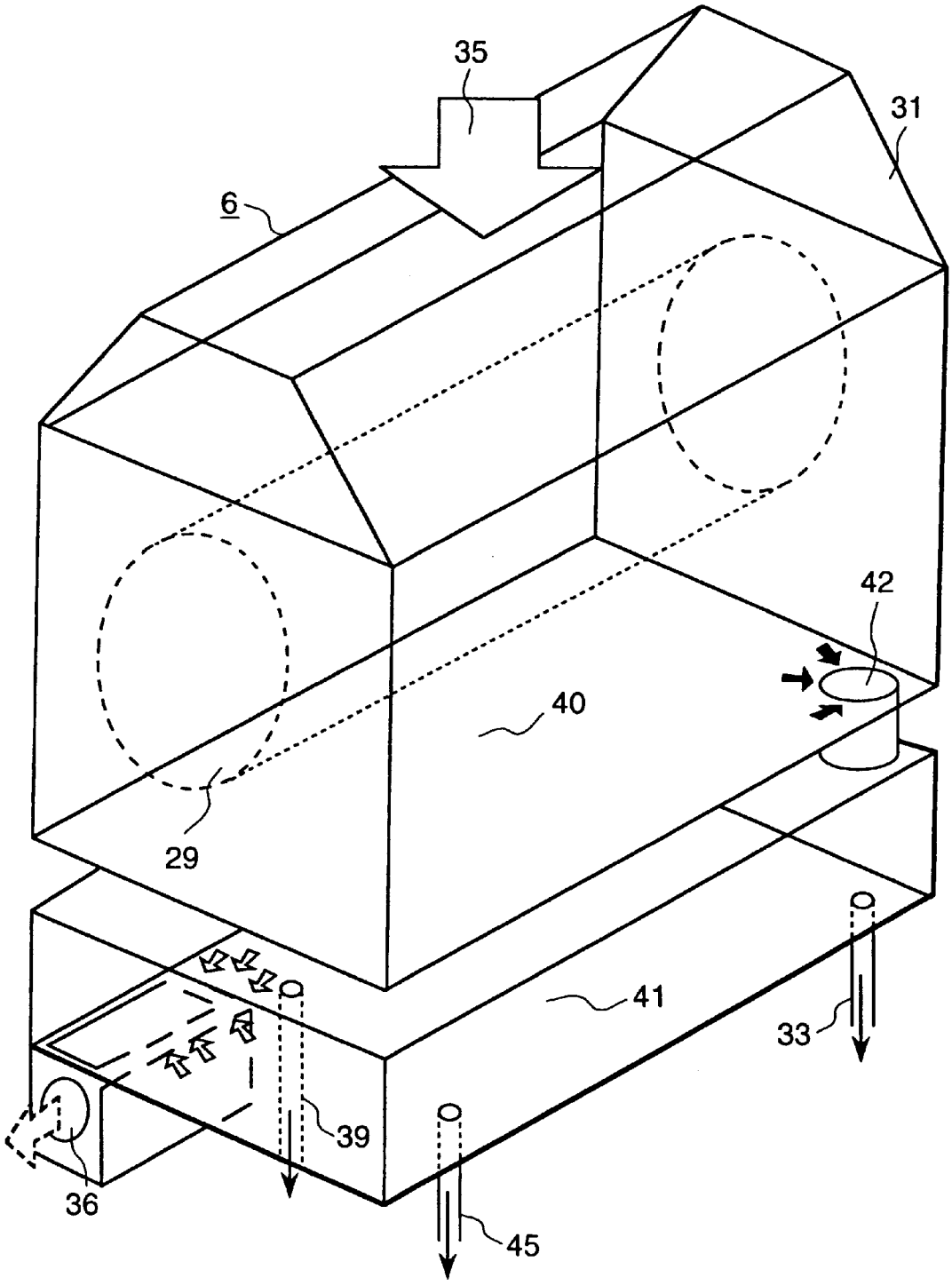
FIG. 8 is a view of another modification of the condenser shown in FIG. 1.

FIG. 8 is a view of another modification of the condenser shown in FIG. 1. In the condenser 6 of the present embodiment, the steam condensing zone 40 and hot well zone 41 are constructed in independent boxes, respectively.

Steam 35 exhausted from the steam turbine flows from an upper portion of the condenser 6 into the steam condensing zone 40 inside a condenser barrel 31. The steam 35 flowed in passes through the tube bundle 29 inside which cooling water such as sea water flows, whereby heat exchange is effected. The heat-exchanged steam 35 is condensed to be condensate and the condensate drops onto a bottom of the steam condensing zone 40 of the box. The condensate dropped on the bottom of the steam condensing zone 40 is introduced into the hot well zone 41 through a communication portion 42 formed at a corner of the steam condensing zone 40. The condensate introduced into the hot well zone 41 is discharged to the outside at the condenser outlet 36. Further, the communication portion 42 communicating the steam condensing zone 40 and the hot well zone 41 is formed so that the condensate flows therein at a farthest portion from the condenser outlet 36 with respect to a water flow inside the hot well zone 41.

Further, in the hot well zone 41, the detection water taking out port 33 for monitoring the quality of condensate is arranged right under the communication portion 42 or in the vicinity thereof, that is, at the most upstream side in the hot well zone 41. Further, the detection water taking out port 39 is arranged at the condenser outlet 36 for discharging the condensate 44 stayed in the hot well zone 41 or in the vicinity thereof, that is, at the most downstream portion in the hot well zone 41. Further, the detection water taking out port 45 is arranged around a middle portion between the detection water taking out port 33 arranged at the portion at which the condensate 44 flows in the hot well zone 41 or in the vicinity thereof and the detection water taking out port 39 arranged at the condenser outlet 36 discharging the condensate 44 stayed in the hot well zone 41 or in the vicinity thereof, or it is arranged at a portion on the way of a flow path in which the condensate 44 flowed in the hot well zone 41 flows to the condenser outlet 36.

According to the present embodiment, even if leakage of cooling water, for example, sea water occurred, it is possible to detect the leakage by the detection water taking out port 33 immediately after sea water-mixed water flows into the hot well zone 41. Further, by arranging the detection water taking out port 33 at the most upstream side in the hot well zone 41, therefore, it is possible to make long a margin in time necessary to take measures for stopping supply of condensate and so on by the time that the condensate mixed with sea water is supplied to the other plant components such as the steam generator, steam turbine and so on.

Further, in the present embodiment, the detecting portions are provided at a plurality of positions of the most upstream and downstream portions in the hot well zone 41 and intermediate portions therebetween, and it is possible to surely judge whether the leakage is on a large scale or on a small scale by examining a degree of change in conductivity difference therebetween. Accordingly, by monitoring a difference in conductivity between at two detecting points, early detection of leakage becomes possible, further it is possible to surely judge whether the leakage of sea water is on a large scale or on a small scale without resetting a limit value for alarm according to operational conditions. Further, in the case where it is judged to be leakage of sea water, countermeasures therefor is selected according to the scale of the sea water leakage in the same manner as in the flow chart of FIG. 4 as previously mentioned.

Figure 9:
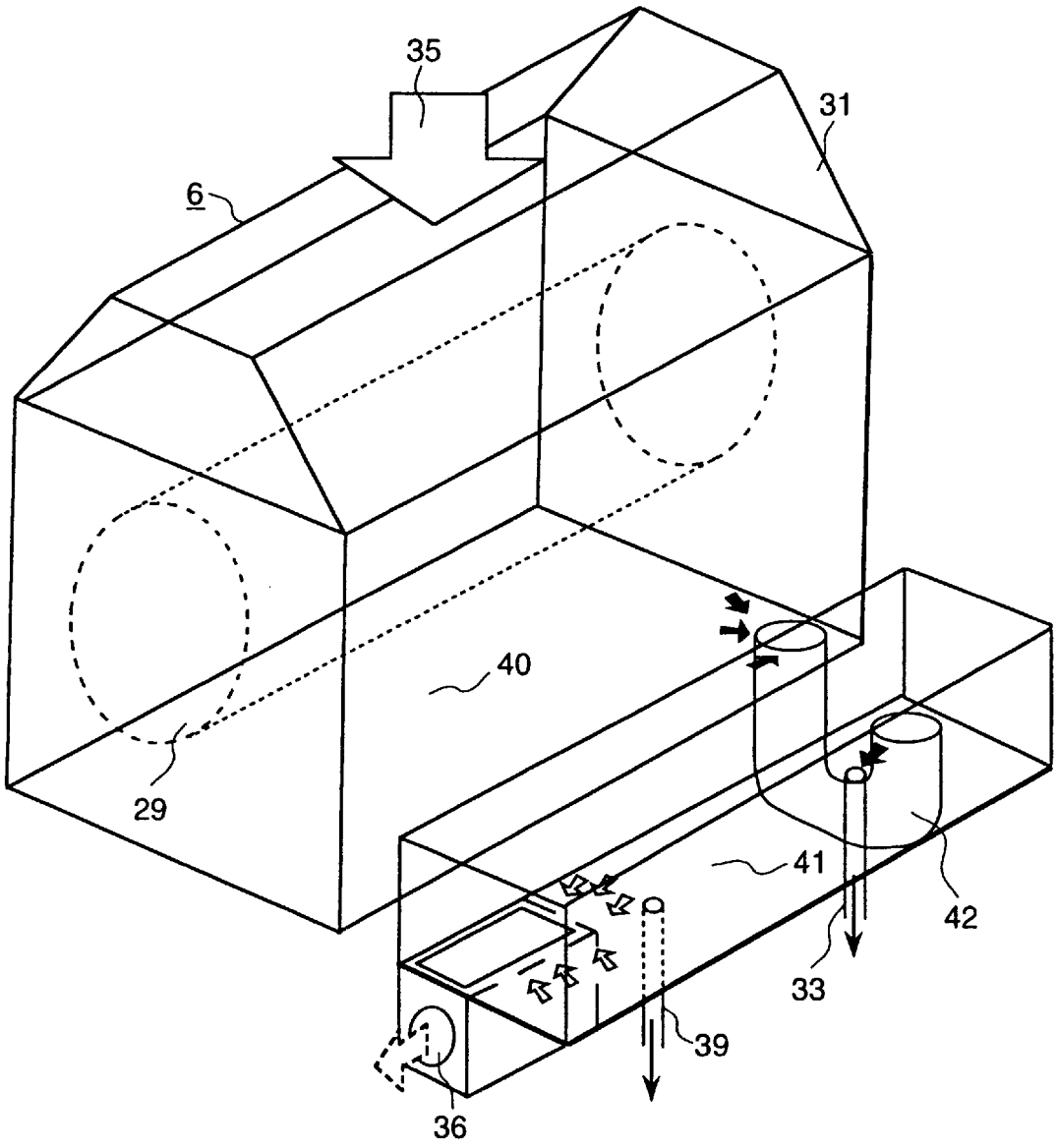
FIG. 9 is a view of another modification of the condenser shown in FIG. 1.

FIG. 9 is a view of another modification of the condenser shown in FIG. 1. In the condenser 6 of the present embodiment, the steam condensing zone 40 and hot well zone 41 are constructed in independent boxes, respectively and arranged in an adjacent relation.

In the same manner as mentioned above, the steam 35 flowed in the condenser 6 is condensed to be condensate and the condensate drops onto a bottom of the steam condensing zone 40 of the box. The condensate dropped on the bottom of the steam condensing zone 40 is introduced into the hot well zone 41 through a communication portion 42 formed at a corner of the steam condensing zone 40. The condensate introduced into the hot well zone 41 is discharged to the outside at the condenser outlet 36. Further, an outlet of the communication portion 42 communicating from the steam condensing zone 40 to the hot well zone 41 is formed so that the condensate flows therein at a farthest portion from the condenser outlet 36 with respect to a water flow inside the hot well zone 41.

Further, in the hot well zone 41, the detection water taking out port 33 for monitoring the quality of condensate is arranged right under the communication portion 42 or in the vicinity thereof, that is, at the most upstream side in the hot well zone 41. Further, the detection water taking out port 39 is arranged at the condenser outlet 36 for discharging the condensate 44 stayed in the hot well zone 41 or in the vicinity thereof, that is, at the most downstream portion in the hot well zone 41.

Further, although particularly not shown in FIG. 9, a detection water taking out port 45 can be arranged around a middle portion between the detection water taking out port 33 and the detection water taking out port 39, or at a portion on the way of a flow path in which the condensate 44 flowed in the hot well zone 41 flows to the condenser outlet 36.

As mentioned above, according to the present embodiment, even if leakage of cooling water, for example, sea water occurs, it is possible to detect the leakage by the detection water taking out port 33 immediately after sea water-mixed water flows into the hot well zone 41. Further, by arranging the detection water taking out port 33 at the most upstream side in the hot well zone 41, it is possible to make long a margin in time necessary to take measures for stopping supply of condensate and so on by the time that the condensate mixed with sea water is supplied to the other plant components such as the steam generator, steam turbine and so on.

Further, in the present embodiment, the detecting portions are provided at a plurality of positions of the most upstream and downstream portions in the hot well zone 41 and intermediate portions therebetween, and it is possible to surely judge whether the leakage is on a large scale or on a small scale by examining a degree of change in conductivity difference therebetween. Accordingly, by monitoring a difference in conductivity between at two detecting points, early detection of the leakage becomes possible, further it is possible to surely judge whether the leakage of sea water is on a large scale or on a small scale without resetting a limit value for alarm according to operational conditions. Further, in the case where it is judged to be leakage of sea water, countermeasures therefor is selected according to the scale of the sea water leakage in the same manner as in the flow chart of FIG. 4 as previously mentioned.

Figure 10:
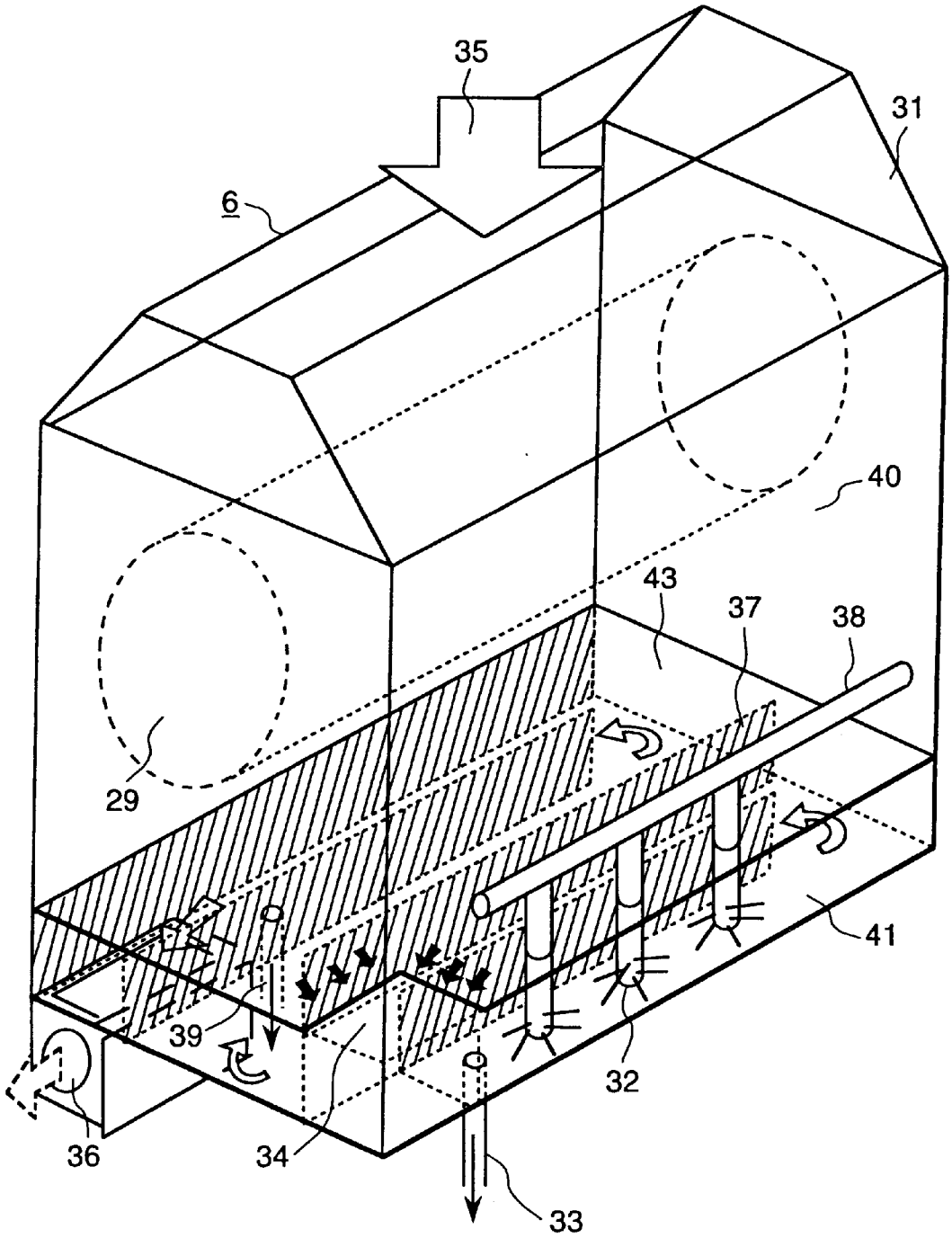
FIG. 10 is a view of another modification of the condenser shown in FIG. 1.

FIG. 10 is a view of another modification of the condenser shown in FIG. 1.

In the present embodiment, the interior of a condenser 6 is partitioned into a steam condensing zone 40 and a hot well zone 41 by a top plate 43, and the interior of the hot well 41 is partitioned by a partition plate 37 to form a narrow path. Further, a deareating steam injection pipe 32 for injecting steam onto condensate in the hot well zone 41 is provided inside the condenser 6. Steam to be injected is led to the interior of the condenser through a deareating steam pipe 38 connected to the deareating steam injection pipe 32.

Steam 35 exhausted from the steam turbine flows from upward of the condenser 6 into the steam condensing zone 40 inside a condenser barrel 31. The steam 35 flowed in there passes through the tube bundle 29 inside which cooling water such as sea water flows, whereby heat exchange is effected. The heat-exchanged steam 35 is condensed to be condensate and the condensate drops onto the top plate 43. The condensate dropped on the top plate 43 flows on the top plate 43 and is introduced into the hot well zone 41 through a communication portion 34 formed at a corner of the top plate 43. The condensate introduced into the hot well zone 41 flows along the narrow path formed by the partition plate 37 and is discharged to the outside at the condenser outlet 36. Further, the communication portion 34 communicating the steam condensing zone 40 and the hot well zone 41 is formed so that the condensate flows therein at a farthest portion from the condenser outlet 36 with respect to a water flow inside the hot well zone 41.

Further, in the hot well zone 41, the detection water taking out port 33 for monitoring the quality of condensate is arranged right under the communication portion 34 or in the vicinity thereof, that is, at the most upstream side in the hot well zone 41. Further, the detection water taking out port 39 is arranged at the condenser outlet 36 for discharging the condensate 44 stayed in the hot well zone 41 or in the vicinity thereof, that is, at the most downstream portion in the hot well zone 41.

Further, although particularly not shown in FIG. 10, a detection water taking out port 45 can be arranged around a middle portion between the detection water taking out port 33 and the detection water taking out port 39, or at a portion on the way of a flow path in which the condensate 44 flowed in the hot well zone 41 flows to the condenser outlet 36.

Further, in the present embodiment, when it is necessary to deareate the condensate at time of start or the like, steam is led to the interior of the condenser through-the deaeration steam pipe 38, and the steam is jetted in the condensate by the deaeration steam injection pipe 32, thereby to urge the condensate to deaerate.

As mentioned above, according to the present embodiment, since an upper portion of the hot well zone 41 is covered widely with the top plate 43 and the hot well zone 41 is partitioned by the partition plate 37 to form the narrow path thereby to cause the condensate to flow along the narrow path, even if leakage of sea water occurs, it is possible to make long a margin in time necessary to take measures for stopping supply of condensate and so on by the time that the condensate mixed with sea water goes into the system from the condenser hot well zone, that is, the condensate mixed with sea water is supplied to the other plant components such as the steam generator, steam turbine and so on. Further, even if the leakage of sea water occurred, since the detection water taking out port 33 is arranged at the most upstream portion in the hot well zone 41, it is possible to detect the leakage of sea water-mixed water immediately after the sea water-mixed water flows in the hot well 41.

Accordingly, by monitoring a difference in conductivity between at two detecting points, early detection of leakage becomes possible, further it is possible to precisely detect only leakage of cooling water, for example, sea water without resetting a limit value for alarm according to operational conditions. Further, in the case where it is judged to be leakage of sea water, countermeasures therefor is selected according to the scale of the sea water leakage in the same manner as in the flow chart of FIG. 4 as previously mentioned.

Figure 11:
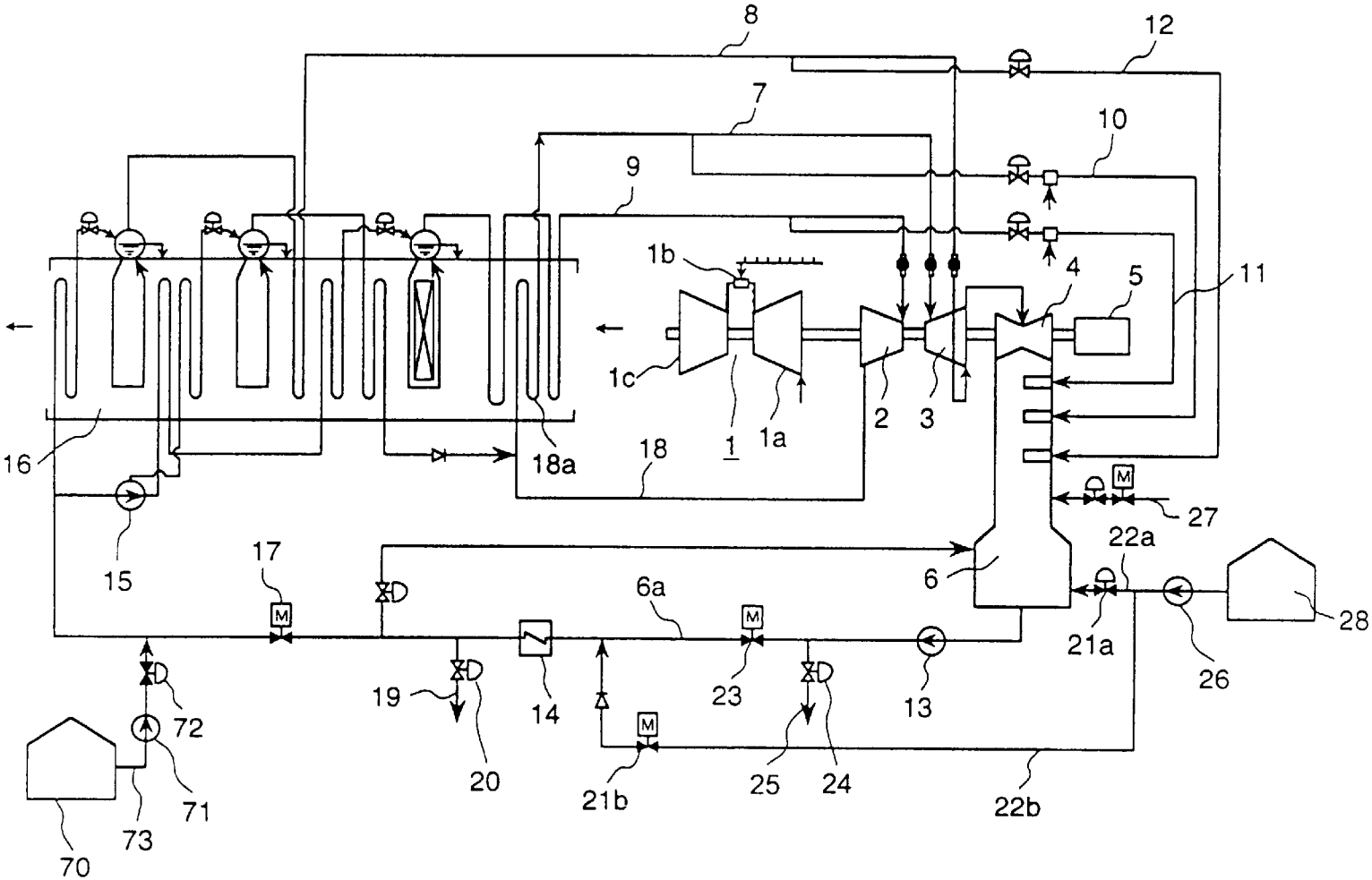
FIG. 11 is a diagram of a system construction of an electric power plant of another embodiment of the present invention.

FIG. 11 is a system construction view of an electric power plant of another embodiment of the present invention. Explanation of the same constructions as in FIG. 2 is omitted here.

In the present embodiment, the make-up water piping 22*b* leading make-up water is connected on the downstream side of the feed water stop valve 23, that is, on the upstream side of the ground steam condenser 14. Further, a discharge pipe 25 with a discharge flow adjusting valve 24 is arranged on the downstream side of the condenser pump 13.

With the above-mentioned construction, when sea water which is cooling water leaks inside the condenser 6, in order to suppress inflow thereof into the exhaust heat recovery boiler 16, the high pressure steam turbine 2, the intermediate pressure steam turbine 3 and the low pressure steam turbine, first, the condensate stop valve 23 arranged at the outlet of the condensate pump 13 is closed, whereby the condensate mixed with sea water and flowed from the condenser 6 is suppressed to flow downstream to separate a leakage portion. Next, in order to secure a feed water quantity necessary for the exhaust heat recovery boiler 16, make-up water is supplied to the downstream side of the condensate stop valve 23 by controlling the make-up water supply valve 21*b* arranged on the make-up water piping 22*b*. Further, internal retaining water which becomes excessive by making up make-up water is discharged out of the system through the discharge piping 25 connected on the downstream side of the condensate pump 13, while adjusting the discharge flow adjusting valve 24.

Figure 12:
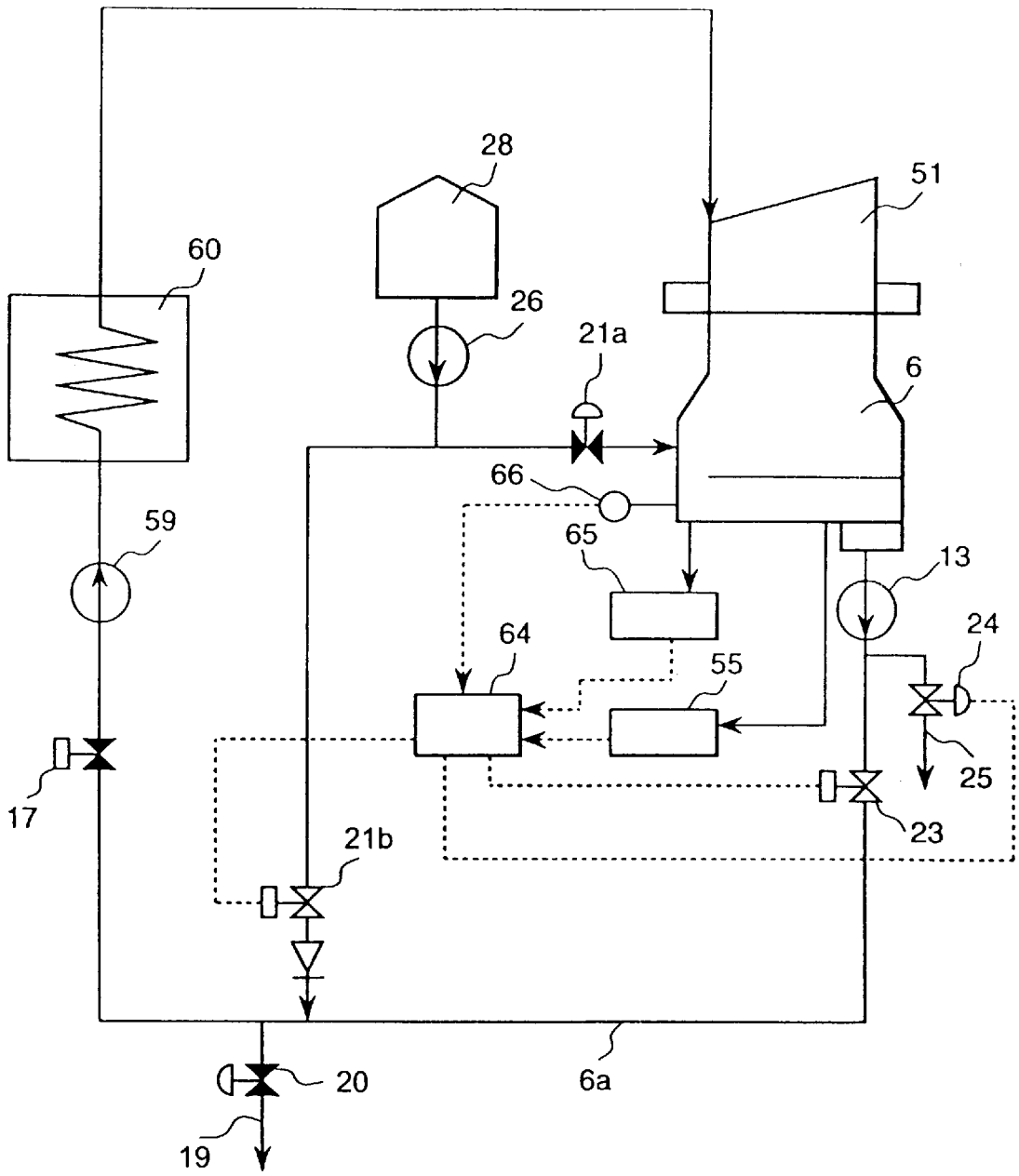
FIG. 12 is a diagram of a simplification of the system construction of the electric power plant shown in FIG. 11.

FIG. 12 is a view of a system construction simplified of one shown in FIG. 11.

At a position right under the tube bundle of a hot well zone not shown of the condenser 6 and at a position of a condenser outlet, detection water taking out ports are provided as previously described, and the water taken out through piping is monitored of its quality at detecting portions 65, 55. Further, the condenser 6 is provided with a water level meter 66, a water level of the condensate stayed in the hot well zone is detected. Information detected at the detecting portions 65, 55 and by the water level meter 66 is transmitted to a controller 64. The controller 64 controls opening/closing of a condensate stop valve 23, make-up water supply valve 21*b* and discharge flow regulating valve 20 on the basis of the transmitted information.

In the present embodiment, detection of condensate is carried out at the detecting portions 65, 55 and the controller 64 detects a change in detection value to judge a degree of leakage. If leakage of cooling water, for example, sea water occurred inside the condenser 6, it is necessary to suppress inflow of sea water-mixed water into plant elements such as the steam turbine and so on and promptly separate the leakage portion. If the degree of leakage is judged to be on a large scale from a detection result, the condensate stop valve 23 arranged on the downstream of the condenser valve 13 is closed, thereby to prevent the sea water-mixed water flowed out of the condenser from flowing downstream. Further, in order to prevent the steam generator 60 from boiling in empty because of stopping water supply, make-up water stored in the make-up water tank 28 is supplied to the feed water piping 6*a* by the make-up water pump 26. Here, in the case where make-up water is supplied and water becomes excessive, the discharge flow regulating valve 24 arranged on the discharge piping 25 is controlled so as to open by the controller 64, whereby excessive water is discharged.

As mentioned above, according to the present embodiment, since it is suppressed for sea water to flow into the steam turbine and so on when the leakage of sea water is on a large scale, upon receipt of a detection signal of the leakage, the controller 64 stops the condensate stop valve 23, makes up the make-up water to a downstream side of the condensate stop valve 23 and discharges, out of the system from a downstream side of the condensate pump 13, the water which became excess by supply of make-up water, whereby it is possible to suppress early and with high reliability the outflow of cooling water-mixed condensate to a downstream side of the condenser and the inflow thereof into the steam turbine 51 or the like through the steam generator 60, without depending on judgment of an operator.

Further, according to the present embodiment, it is possible to effect load down to a safety load at which an effect of leakage is not affected to the plant components, without emergency stop of the plant.

Further, when the sea water leakage is judged to be on a small scale, while continuing the operation of the plant, chemical or chemical dilution water in the chemical storage tank is supplied to the feed water piping 6*a*, and then the plant is stopped by manual. By controlling in the manner as mentioned above, a load down operation to a load at which an effect of the leakage is not affected to the plant components can be conducted without emergency stop.

According to the present invention, there is an effect that it is possible to detect early leakage of cooling water and to suppress inflow of water mixed with sea water due to leakage of sea water, or the like into the steam generator and steam turbine.

What is claimed is:

1. A condenser condensing steam flowed therein from a turbine into condensate and supplying the condensed condensate into a feed water system leading to a steam generator, wherein said condenser comprises a steam condensing zone having a heat exchanger tube bundle and condensing steam and a hot well zone allowing the condensate condensed in said steam condensing zone to stay therein, a plurality of detectors for detecting the quality of the condensate or detection ports for taking out a sample of the condensate are provided in said hot well zone, and a control valve adjusting supply of the condensate to be supplied from said condenser to said feed water system on the basis of water quality detection values detected by said plurality of detectors or detection ports is provided on said feed water system, and a make-up water system supplying make-up water to said feed water system on the downstream side of said control valve is provided.

2. A condenser according to claim 1 which further includes a chemical injecting system supplying chemical dilution water to said feed water system on the basis of water quality detection values detected by said plurality of detectors or detection ports.

3. A condenser according to claim 1, wherein said detectors or detection ports are arranged separately from each other in a course leading from an upstream side of said hot well zone into which the condensate flows from said steam condensing zone to a downstream side of said hot well zone from which the condensate flows out into said feed water system, and a judging device is provided for comparing respective water quality values detected by said detectors or detection ports, and judging sea water leakage when a water quality detection value detected by said detectors or detection ports on the upstream side represents to be lower in water quality than a water quality detection value detected by said detectors or detection ports on the downstream side.

4. A condenser condensing steam flowed therein from a turbine into condensate and supplying the condensed condensate into a feed water system leading to a steam generator, wherein said condenser comprises a steam condensing zone having a heat exchanger tube bundle and condensing steam, a hot well zone allowing the condensate condensed in said steam condensing zone to stay therein and a condensate outlet portion leading the condensate stayed in said hot well zone from said condenser to said feed water system, a first detecting means for detecting the quality of the condensate is provided in said hot well zone right under the heat exchanger tube bundle forming said steam condensing zone and a second detecting means for detecting the quality of the condensate is provided at said condensate outlet portion or in the vicinity of said condensate outlet portion, a control valve adjusting supply of the condensate to be supplied from said condenser to said feed water system on the basis of a difference between water quality detection values of the condensate detected by said first and second detecting means is provided on said feed water system, and a make-up water system supplying make-up water to said feed water system on the downstream side of said control valve is provided.

5. A condenser according to claim 4 which further includes a chemical injecting system supplying chemical dilution water into said feed water system on the basis of a difference between water quality detection values detected by said first and second detecting means.

6. A condenser according to claim 4, wherein said condenser is provided with a judging device for comparing a difference between respective water quality values of the condensate detected by said first and second detecting means, and judging sea water leakage when a water quality detection value detected by said first detecting means represents to be lower in water quality than a water quality detection value detected by said second detecting means.

7. A power plant equipment comprising a steam generator generating steam, a steam turbine driven by the steam generated in said steam generator, a condenser condensing the steam exhausted from said steam turbine into condensate, and a feed water system supplying the condensate to said steam generator, wherein said condenser comprises a steam condensing zone having a heat exchanger tube bundle and condensing steam and a hot well zone allowing the condensate condensed in said steam condensing zone to stay therein, a plurality of detectors for detecting the quality of the condensate or detection ports taking out a sample of the condensate are provided in said hot well zone, a control valve adjusting supply of the condensate to be supplied from said condenser to said feed water system on the basis of a detection value detected by said plurality of detectors or detection ports is provided on said feed water system, and a make-up water system communicating with said feed water system on the downstream side of said control valve and supplying make-up water is provided.

8. A power plant equipment according to claim 7 which further includes a chemical injecting system supplying chemical dilution water to said feed water system on the basis of water quality detection values detected by said plurality of detectors or detection ports.

9. A power plant equipment comprising a steam generator generating steam, a steam turbine driven by the steam generated in said steam generator, a condenser condensing the steam exhausted from said steam turbine into condensate, and a feed water system supplying the condensate to said steam generator, wherein said condenser comprises a steam condensing zone having a heat exchanger tube bundle and condensing steam, a hot well zone allowing the condensate condensed in said steam condensing zone to stay therein and a condensate outlet portion leading the condensate stayed in said hot well zone from said condenser to said feed water system, a first detecting means for detecting the quality of the condensate is provided in said hot well zone right under the heat exchanger tube bundle forming said steam condensing zone and a second detecting means for detecting the quality of the condensate is provided at said condensate outlet portion or in the vicinity of said condensate outlet portion, a control valve adjusting supply of the condensate to be supplied from said condenser to said feed water system on the basis of a difference between water quality detection values of the condensate detected by said first and second detecting means when the quality of the condensate is lowered is provided on said feed water system, and a make-up water system supplying make-up water to said feed water system on the downstream side of said control valve is provided.

10. A power plant equipment according to claim 9 which further includes a chemical injecting system supplying chemical dilution water into said feed water system on the basis of a difference between water quality detection values detected by said first and second detecting means when the water quality of the condensate is lowered is provided.

11. A power plant equipment according to claim 7, wherein said power plant equipment further includes a make-up water tank having make-up water stored therein and a make-up water supply device for supplying the make-up water stored in said make-up water tank to said condenser or said feed water system.

12. A power plant equipment according to claim 8, wherein said power plant equipment further includes a chemical storage tank storing chemical dilution water for neutralizing the condensate mixed with sea water, and a chemical dilution water supplying device for supplying the chemical dilution water stored in said chemical storage tank to said condenser or said feed water system.

13. A power plant equipment according to claim 7, wherein said power plant equipment further includes a discharging system for discharging, out of said feed water system, condensate on the upstream side of said control valve.

14. A condenser condensing steam flowed therein from a turbine into condensate and supplying the condensed condensate into a feed water system leading to a steam generator, wherein said condenser comprises a steam condensing zone having a heat exchanger tube bundle and condensing steam and a hot well zone allowing the condensate condensed in said steam condensing zone to stay therein, a plurality of detectors for detecting the quality of the condensate and detection ports for taking out a sample of the condensate are provided in said hot well zone, and a control valve adjusting supply of the condensate to be supplied from said condenser to said feed water system on the basis of water quality detection values detected by said plurality of detectors and detection ports is provided on said feed water system, and a make-up water system supplying make-up water to said feed water system on the downstream side of said control valve is provided.

15. A condenser according to claim 14 which further includes a chemical injecting system supplying chemical dilution water to said feed water system on the basis of water quality detection values detected by said plurality of detectors and detection ports.

16. A condenser according to claim 14, wherein said detectors and detection ports are arranged separately from each other in a course leading from an upstream side of said hot well zone into which the condensate flows from said steam condensing zone to a downstream side of said hot well zone from which the condensate flows out into said feed water system, and a judging device is provided for comparing respective water quality values detected by said detectors and detection ports, and judging sea water leakage when a water quality detection value detected by said detectors and detection ports on the upstream side represents to be lower in water quality than a water quality detection value detected by said detectors and detection ports on the downstream side.

17. A power plant equipment comprising a steam generator generating steam, a steam turbine driven by the steam generated in said steam generator, a condenser condensing the steam exhausted from said steam turbine into condensate, and a feed water system supplying the condensate to said steam generator, wherein said condenser comprises a steam condensing zone having a heat exchanger tube bundle and condensing steam and a hot well zone allowing the condensate condensed in said steam condensing zone to stay therein, a plurality of detectors for detecting the quality of the condensate and detection ports for taking out the condensate are provided in said hot well zone, a control valve adjusting supply of the condensate to be supplied from said condenser to said feed water system on the basis of a detection value detected by said plurality of detectors and detection ports is provided on said feed water system, and a make-up water system communicating with said feed water system on the downstream side of said control valve and supplying make-up water is provided.

18. A power plant equipment according to claim 17 which further includes a chemical injecting system supplying chemical dilution water to said feed water system on the basis of water quality detection values detected by said plurality of detectors and/or detection ports is provided.

* * * * *